US011547139B2

(12) United States Patent
Richmond et al.

(10) Patent No.: US 11,547,139 B2
(45) Date of Patent: Jan. 10, 2023

(54) COMPACT SYSTEM FOR PREPARING PERSONAL SMOKABLE PRODUCTS

(71) Applicant: Banana Bros, LLC, Culver City, CA (US)

(72) Inventors: David Richmond, Culver City, CA (US); Howard Richmond, Los Angeles, CA (US); Manuel A. Montano, Gardena, CA (US); Jeffery Kunkler, Culver City, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 16/172,639

(22) Filed: Oct. 26, 2018

(65) Prior Publication Data

US 2019/0059439 A1 Feb. 28, 2019

Related U.S. Application Data

(63) Continuation-in-part of application No. 15/447,069, filed on Mar. 1, 2017, now Pat. No. 9,814,259.

(60) Provisional application No. 62/450,535, filed on Jan. 25, 2017.

(51) Int. Cl.

| | |
|---|---|
| ***A24C 5/42*** | (2006.01) |
| ***A24B 7/04*** | (2006.01) |
| ***A24C 5/06*** | (2006.01) |
| ***A24C 5/44*** | (2006.01) |
| ***A24C 5/02*** | (2006.01) |
| *B02C 7/04* | (2006.01) |
| *B02C 18/10* | (2006.01) |
| *B02C 23/16* | (2006.01) |

(52) U.S. Cl.

CPC ..... *A24C 5/42* (2013.01); *A24B 7/04* (2013.01); *A24C 5/02* (2013.01); *A24C 5/06* (2013.01); *A24C 5/44* (2013.01); *B02C 7/04* (2013.01); *B02C 18/10* (2013.01); *B02C 23/16* (2013.01)

(58) Field of Classification Search

CPC .... A24C 5/02; A24C 5/42; A24C 5/44; A24C 5/06; A24B 7/04; B02C 7/04; B02C 18/10; B02C 23/16

See application file for complete search history.

(56) References Cited

U.S. PATENT DOCUMENTS 2,284,789 A * 6/1942 Allen ..... A47J 42/16 241/296
5,845,561 A * 12/1998 Chigira et al. ..... A47J 31/42 99/289 R
9,776,192 B2 * 10/2017 Ebadian et al. ..... B02C 18/18
(Continued)

*Primary Examiner* — Dionne W. Mayes
(74) *Attorney, Agent, or Firm* — Smyrski Law Group, A P.C.

(57) ABSTRACT

An apparatus for preparing a smokeable product is provided. The apparatus includes an upper chamber configured to receive feed material, a feed material cutting mechanism comprising a size reducer configured to rotate in two directions, a motor configured to rotate the feed material cutting mechanism, a controller configured to selectively reverse direction of rotation of the feed material cutting mechanism, a power source configured to drive the motor, a switch for turning the power source off and on, and a fan in the uppermost chamber configured to move feed material within the uppermost chamber to a lowermost chamber.

20 Claims, 16 Drawing Sheets

(56) References Cited

U.S. PATENT DOCUMENTS

| | | | | |
|---|---|---|---|---|
| 2003/0057305 | A1* | 3/2003 | Watano et al. | H02P 29/02 241/36 |
| 2003/0178959 | A1* | 9/2003 | Wong et al. | A47J 42/44 318/364 |
| 2005/0199756 | A1* | 9/2005 | Kato et al. | B02C 23/24 241/65 |
| 2016/0287016 | A1* | 10/2016 | Lammers et al. | A47J 31/42 |
| 2017/0259273 | A1* | 9/2017 | Cottam et al. | B02C 7/04 |
| 2021/0069721 | A1* | 3/2021 | McCall et al. | B02C 18/2216 |

* cited by examiner

COMPACT SYSTEM FOR PREPARING PERSONAL SMOKABLE PRODUCTS

The present application is a continuation-in-part of U.S. patent application Ser. No. 15/447,069 titled "Compact System for Preparing Personal Smokeable Products" filed Mar. 1, 2017, which claims the benefit of U.S. Provisional Patent Application No. 62/450,535 titled "Compact System for Preparing Personal Smokeable Products," filed Jan. 25, 2017, the contents of which are incorporated in this disclosure by reference in their entirety.

BACKGROUND

I. Field

The present invention relates generally to devices and methods for preparing a smokable product starting with gross sized feed material.

II. Background

Products for preparing cigarettes and other smokeable products are known. For example, see: WO02056714A1, DK177367B, DE3427480A1, GB2124882, and EP1374705A1.

A problem with many existing products is that they are unable to quickly and easily prepare a smokeable product starting with gross sized feed material. It is desirable that there be a portable, easy to use device that can produce a final product in a short a period of time.

SUMMARY

Thus according to the present design, there is provided an apparatus for preparing a smokeable product comprising an upper chamber configured to receive feed material, a feed material cutting mechanism comprising a size reducer configured to rotate in two directions, a motor configured to rotate the feed material cutting mechanism, a controller configured to selectively reverse direction of rotation of the feed material cutting mechanism, a power source configured to drive the motor, a switch for turning the power source off and on, and a fan in the uppermost chamber configured to move feed material within the uppermost chamber to a lowermost chamber.

According to another aspect of the present design, there is provided an apparatus for preparing a smokeable product comprising a chamber and a lower chamber configured to receive smokable material a size reducer positioned within the chamber and configured to reduce smokeable material size, and a controller configured to alter movement of the size reducer when resistance to size reducer movement is encountered while the size reducer interfaces with the smokeable material provided in the chamber.

According to a further aspect, there is provided an apparatus for providing smokable material comprising a chamber formed by a plurality of joinable container elements and configured to receive smokable material, a size reducer positioned within the chamber and configured to reduce smokeable material size, and a controller configured to alter movement of the size reducer when resistance has been encountered by the size reducer from the smokeable material provided in the chamber.

To the accomplishment of the foregoing and related ends, certain illustrative aspects are described herein in connection with the following description and the annexed drawings.

These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
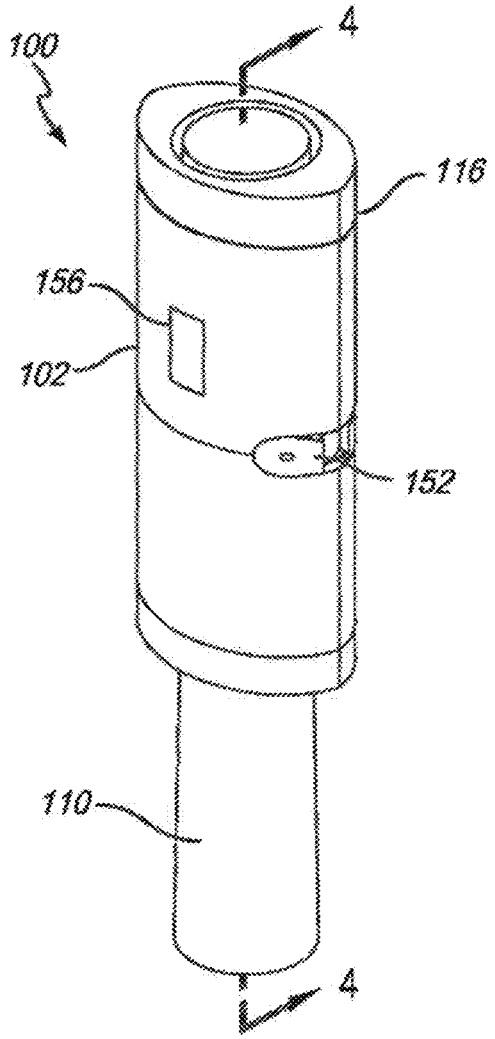
FIG. 1 is a perspective view of a first apparatus having features of the present design.

The present design provides a system, including an apparatus that can be portable and hand holdable, or larger for commercial or industrial use. The apparatus comprises a wall providing at least one chamber, such as an upper chamber and a lower chamber, may provide a grate between the chambers. A fill inlet can be used for placing feed smokeable material into the uppermost chamber. A cutting mechanism, such as a rotatable size reducer, located in the uppermost chamber allows for reducing the size of feed smokeable material in the uppermost chamber a sufficient amount that size reduced smokeable material can pass through the grate out of the uppermost chamber, such as into the lowermost chamber, where it can be used as fill smokeable material.

A support is provided below the lower chamber for supporting a wrapper below the lower chamber, and optionally extending through the opening of the lowermost chamber. The support is removably attached to the lower chamber. There is an opening in the lower chamber that allows for fill smokeable material to pass into the wrapper supported by the support.

The size reducer can be manual or powered. A motor can power rotation of the size reducer, and a power source such as a battery or external power source can drive the motor. There can be a switch for turning the power source off and on. The switch can provide variable speeds, have fixed different speed positions, or be an on-off switch for a constant speed motor. The switch is preferably located on the outside of the wall.

The size reducer can be a rotatable blade, wires attached to a drive or rotatable shaft, or a grinder comprising a rotatable grinding plate, also referred to as a comminution plate, with a grinder having first grinding projections, and a grinding surface, also referred to as a comminution plate, having second grinding projections opposed to the first grinding projections for grinding smokeable material between the first and second grinding projections. The size reducer can rotate both clockwise and counterclockwise. The apparatus can have a biasing means, such as a spring, for biasing the size reducer toward the grinding surface. The spring can move the size reducer and the grinding surface toward each other as ground smokeable material is discharged through the opening. The spring can provide one to five pounds of force.

To prevent clogging and accumulation of smokeable material around a central projection, one or more projections may have cutting blades or wires on their side surface. Thus, the design can include a device for comminuting smokeable material comprising a first rotatable comminution plate having a rotational axis with a plurality of first projections extending from the plate, each of the first projections having a base proximate to the first plate and a side surface, one of the first projections being an axial projection at the rotational axis. The device includes a second comminution plate opposed to the first plate, the second plate having a plurality of second projections, the first and second projections oriented so that during a comminution operation when the first plate is rotated about the rotational axis, the first and second projections cooperate to comminute smokeable material. A plurality of cutting blades or wires extend from the side surface of the axial projection. The cutting blades or wires can extend at an angle of from about 80 degrees to about 10 degrees, and preferably 30 degrees away from the base of the axial projection relative to the plane of the side surface of the axial projection. A central projection of the second projection can also have a plurality of cutting blades or wires extending from its side surface.

The size reducer can be moveable, with a first position distal from the grate and a second position closer to the grate. The moveable size reducer can contain biasing means for biasing the size reducer to the second position.

The apparatus may include a sieve in one or more chambers to assist in separating smokeable material. The sieve can be secured to a shaft attached to a motor so that it may be rotated clockwise or counter clockwise to facilitate the movement of smokeable material through the holes of the sieve.

To prevent clogging and accumulation of smokeable material in the chambers, and to assist in moving smokeable material out the chambers, a motorized fan or blower can be secured in one or more chambers. The fan or blower can be secured to a shaft attached to a motor so that it may be rotated clockwise or counter clockwise to facilitate the movement of smokeable material out of the chambers.

To make the device an all in one device that can start with feed material and end with a wrapper filled smokeable material, preferably a moveable tamper is in the lower chamber for tamping fill smokeable material in the wrapper. The tamper has an upper position and a lower position. Preferably a biasing means such as a spring is provided for biasing the tamper into its upper position, and a mechanism for moving the tamper from its upper position to a lower position against the biasing means for the purpose of tamping the smokeable material in the wrapper.

Preferably the tamping mechanism also provides a piston-like effect so that pushing downwardly compresses air in the lower chamber, thereby forcing fill smokeable material into the wrapper and compressing it therein for a consistent, uniform smoke.

There is also provided a spring biasing the enclosing wall to the upper position, wherein the enclosing wall is movable downwardly from an upper position to a lower position relative to the support for moving the grate downwardly. The biasing means can be located in the wall. The tamper also moves downwardly to tamp fill smokeable material in the wrapper.

The drive can be manual or powered. When powered, the drive can comprise a size reducer in the uppermost chamber, a motor for rotating a blade or wires, a power source such as a battery or external power source for driving the motor, and a switch or button for turning the power source off and on. A fan or blower may be attached to the drive to produce airflow within the upper chamber. A sieve may be attached to the drive so that it will rotate when the power source is turned on to separate smokeable material within the chamber The switch or button can provide variable speeds, have fixed different speed positions, or be an on-off switch for a constant speed motor. The switch is preferably located on the outside of the wall.

In a manual version of the design, which can optionally be provided with the powered version, the rotatable size reducer can comprise a coupler coupling the upper portion of the wall to the rotatable size reducer for rotating the size reducer, wherein the upper portion of the wall is rotatable relative to the lower portion of the wall and is graspable by a user's hand.

Preferably the support is tubular with a generally cylindrical elongated opening for receiving the wrapper, which can be a conventional wrapper such as a cigarette wrapper. The elongated opening can be conical, being wider at the top than at the bottom for receiving a conical shaped wrapper. Preferably the support is easily removably secured in position such as by a magnet. For example, the support can be removably secured to the grate and can be removed from the lower portion of the housing for attachment to the upper portion of the housing.

Optionally, a projection can be supported by the wall, where the projection is sized for pushing a wrapper containing smokeable material partially out of the support for easy access by a user for removing the wrapper out of the support.

The apparatus can be provided with a wrapper or without a wrapper.

Preferably at least the bottom portion of the tamper is made from flexible material, such as rubber, the stiffness of the rubber controlling how much compression can be provided to the fill smokeable material in the wrapper. The apparatus can be provided as a kit comprising two or more tampers, differing in size and/or hardness. Also, the design contemplates selling the tamper separately from the remainder of the apparatus, wherein the tamper is removable, such as being held in place by a magnet.

Similarly, the grate can be removable so grates with different sized holes can be used depending on the preference of a user. The grate may be connected to the motor, drive, or shaft attached to the drive to rote the grate to facilitate the movement of smokeable material out of the uppermost chamber.

The size reducer can comprise a blade, a grinder/chopper, mincer, wires, or combination thereof. For example, a grinding plate having first grinding projections opposed to second grinding projections, which can be on the grate, can be used for grinding feed smokeable material between the projections.

The opening in the lowermost chamber can be funnel shaped, being narrower at the bottom than at the top, and preferably shaped at the bottom to fit into the top opening of the wrapper.

Preferably at least a portion of the housing is sufficiently translucent or transparent so that feed smokeable material in the upper chamber is visible to a user.

Optionally the apparatus includes a storage area for smokeable material above the upper chamber, separate from both the upper and lower chambers.

The fill inlet can be an opening in the upper chamber of the wall such as a door.

In a method of using the apparatus, feed smokeable material is placed through the fill opening into the uppermost chamber. If the device includes a storage chamber, the feed material can be taken from the storage chamber. A wrapper is supported with the support. The size reducer is activated for reducing the size of feed smokeable material so at least a portion of the smokeable material falls through the grate so smokeable material out of the uppermost chamber and thereafter through the opening in the lowermost chamber into the wrapper. The grate may be rotated to allow smokeable material to pass through the grate more easily. If a fan or blower is provided, the fan or blower is activated for facilitating the movement of smokeable material from the uppermost chamber, through the grate, and out of the lower chamber. A sieve may be included to help separate smokeable material. The sieve may be rotated to facilitate movement of smokeable material through the sieve. If the tamper is provided, the tamper is forced downwardly against the force of the biasing means for tamping fill smokeable material in the wrapper. The user can inspect the wrapper for the amount of smokeable fill material in the wrapper, and if more fill is desired, tamping can be repeated. Subsequently, the support is removed from the lower chamber and filled wrapper is removed from the support, and then the support can be reattached to the lowermost chamber. The tamping can be performed multiple times.

In the version of the design where there is a projection on the housing sized for pushing the wrapper containing fill smokeable material from the support after removing the support from the lower chamber, the projection can be used to push the wrapper containing fill smokeable material from the support. The support can be attached to the upper portion of the wall after being removed.

In the powered version of the design, optionally the motor can be adapted to vibrate smokeable material in the upper chamber to help the feed material engage the size reducer as well as vibrate the lower chamber and support in order to aid in packing the smokeable material into the wrapper. The motor can also be adapted to rotate a fan within a chamber, or to rotate the grate to facilitate the movement of smokeable material within the chamber.

There are many advantages to the present design, not all of which need to be present in every version of the design. Exemplary of the advantages are that the system can produce a smokeable product from feed material within as few as 10 seconds, be inexpensive, provide everything needed starting with raw feed material to a final product, be adjustable by the user with replaceable tampers, be adjustable by the user by interchanging grates, provide a storage compartment, allow visibility of the feed material in at least the upper chamber so that the user can be sure to have sufficient material, provide a mechanism for easily removing the filled wrapper from a support, be used with conventional, commercially available wrappers, with the tamping feature, allow the user to a desired amount of compression and fill, and for users without sufficient wrist strength or a handicap, powered (with or without being mechanically usable, i.e. with or without an ability for the user to manually grind product).

In general, with regard to FIGS. 1 to 27, an apparatus 100, 200, 300, 400, 500, 600, 700 according to the present design can comprise, as its main elements a wall 102 providing one or more chambers, such as upper chamber 104 and a lower chamber 106, a fill inlet 156 for placing feed smokeable material into the uppermost chamber, such as the upper chamber 104, a rotatable size reducer 230 in the uppermost chamber for reducing the size of feed smokeable material in the uppermost chamber, a drive 226 for rotating the rotatable size reducer 230, a support 110 below the lower chamber 106 for supporting a wrapper 120 below the lower chamber 106, an opening in the lower chamber 106 for fill smokeable material to pass into the wrapper 120 supported by the support 110, and an axially moveable tamper 142 in the lower chamber 106 for tamping fill smokeable material in the wrapper 120.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used herein, the term "comprise" and variations of the term, such as "comprising" and "comprises," are not intended to exclude other additives, components, integers or steps.

As used herein, "smokeable material" can be any material that is able to be smoked such as, for example, tobacco, marijuana, herbs, or a medicinal substance. The smokeable material can be pure, or it can contain material such as stems or seeds that can be smoked even if not removed, and additives such as flavorants.

"Feed" smokeable material refers to starting smokeable material. Feed smokeable material can contain a large portion of smokeable material, as well as seeds and stems.

As used herein, smokeable material that is cut or sized to pass through the grate is referred to as "fill" smokeable material. The fill smokeable material is cut by a size reducer a sufficient amount such that the cut smokeable material can pass through the grate into the lower chamber. However, it is possible that the feed smokeable material can be correctly sized to pass through the grate without being cut by the size reducer.

The term "fill inlet" as used herein is an inlet into the upper chamber of an apparatus according to this design used to place feed smokeable material into the upper chamber. The fill inlet can be an opening in the wall of the upper chamber. Optionally, the opening has a door.

A "grate" contains holes such that the fill smokeable material can pass through the holes of the grate and into the lower chamber. The grate can be removable. The grate can be made from metal, plastic, or the like.

A "smokeable product" is the wrapper containing fill smokeable material. The smokeable product can be, for example, a tobacco cigarette, a marijuana cigarette, or a *cannabis* cigarette.

The term "wrapper" as used herein refers to a paper or other combustible material such as tobacco leaf such as is used for cigars. Preferably, the wrapper is conical and sized to fit into the support.

A "tamper" as used herein, is an object used for tamping, or compressing, smokeable material into the wrapper.

With reference to FIGS. 1 to 23, an apparatus 100, 200, 300, 400, 500, 600, 700 having features of the design can be used to quickly and easily make cigarettes made out of tobacco or other smokeable material.

An enclosing wall 102 may provide one or a plurality of chambers, such as an upper chamber 104 and a lower chamber 106. The chambers can be any shape, such as, for example, the chambers can have a circular or ovoid shape in horizontal cross-section. The enclosing wall 102 can be made out of any type of rigid material, such as, for example, plastic, glass, or metal. Part or all of the wall 102 can be transparent or translucent such that smokeable material is visible inside the chamber. Additionally, there can be decorative lights located in the wall 102.

Figure 2:
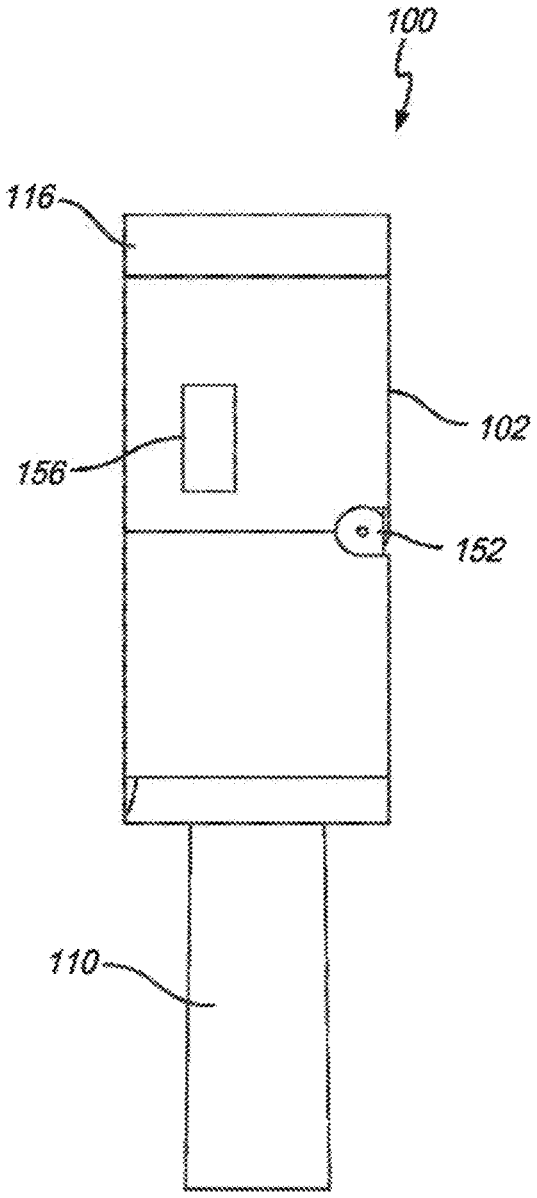
FIG. 2 is a front elevation view of the apparatus of FIG. 1.
Figure 3:
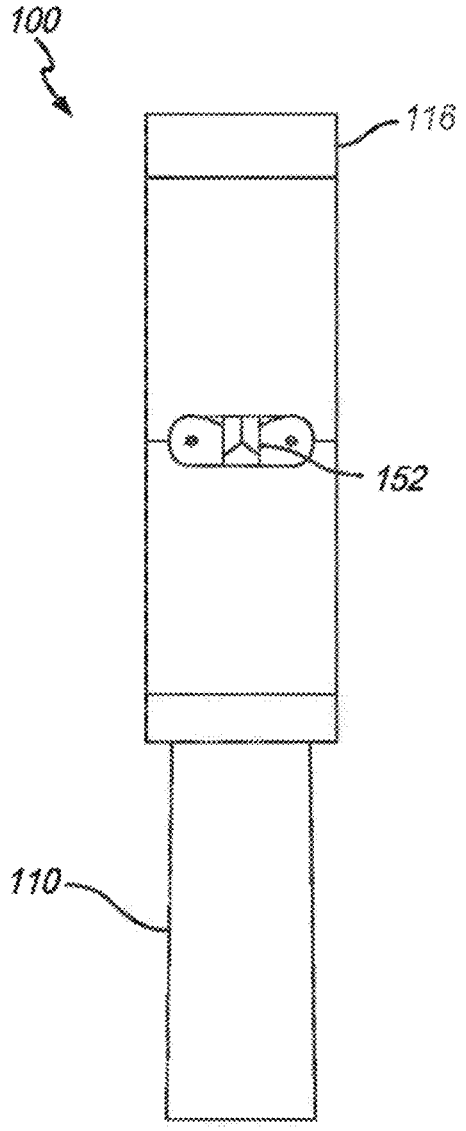
FIG. 3 is a side elevation view of the apparatus of FIG. 1.

One chamber, such as the upper chamber 104, provides a receptacle for the feed smokeable material. The feed smokeable material can be directly placed in the upper chamber 104 upon separation of a lid 116 from the upper chamber 104, or there can be a fill inlet 156 such as a door or a flap in the wall 102 or lid 116 such that feed smokeable material can be placed in or added to the upper chamber 104 without separating the lid 116 from the upper chamber 104, as shown in FIGS. 1-3. In one embodiment, the upper chamber 104 contains a manual or automatic size reducer, described further below.

Figure 5:
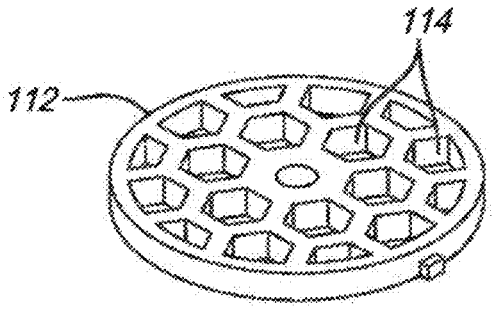
FIG. 5 is a perspective view of one embodiment of a grate useful with the first apparatus.
Figure 6:
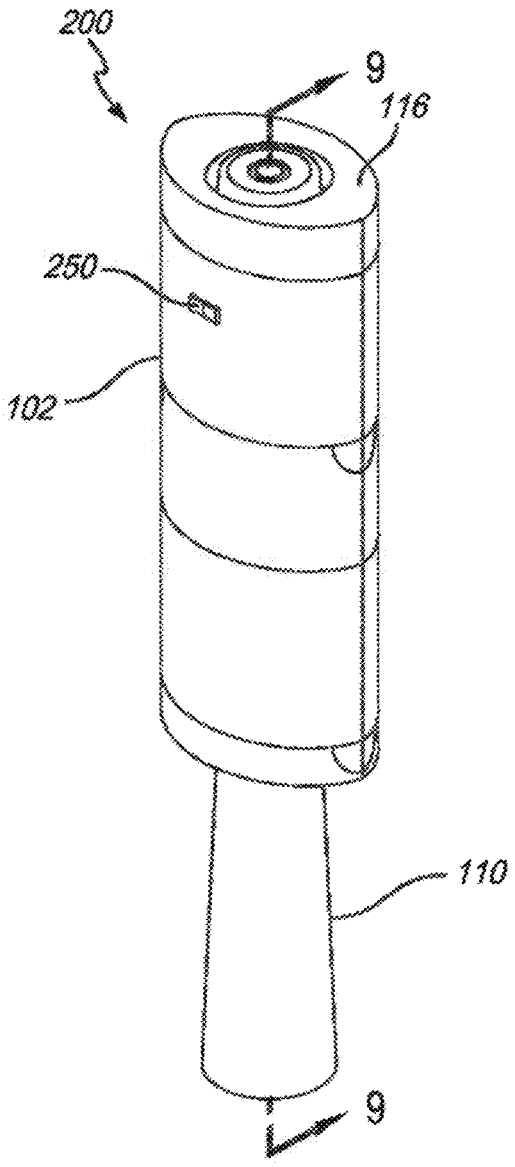
FIG. 6 is a perspective view of a second apparatus having features of the present design.
Figure 7:
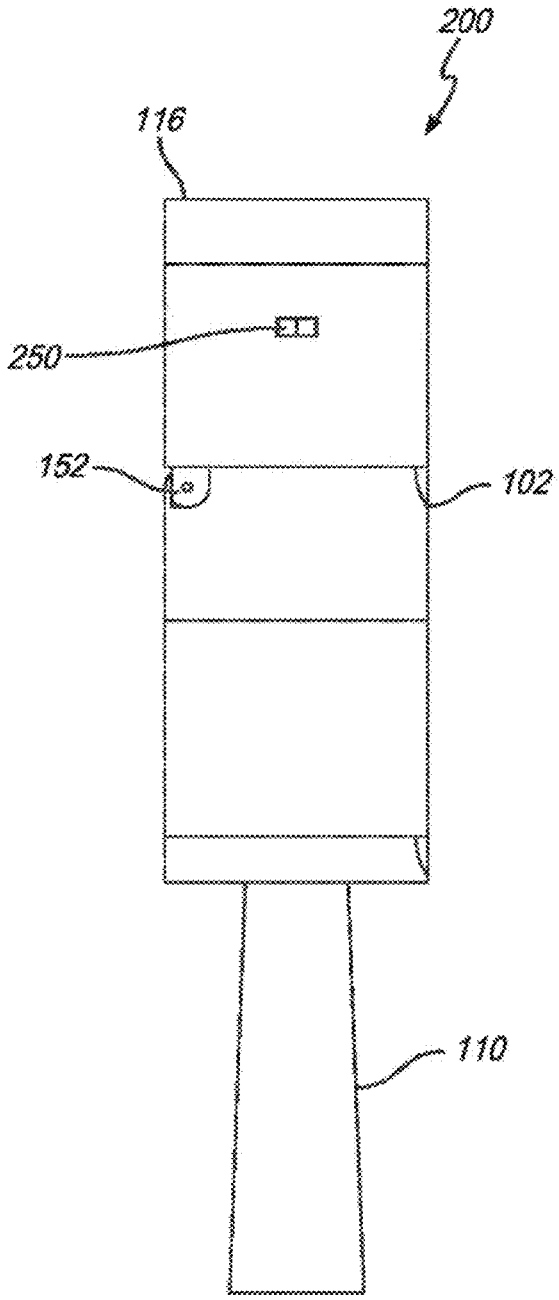
FIG. 7 is a front elevation view of the apparatus of FIG. 6.

The apparatus 100, 200, 300, 400, 500 contains a grate 112 located in one chamber or between the upper chamber 104 and the lower chamber 106. The grate 112 is made out of a rigid or semi-rigid material such as, for example, plastic or metal. As shown in FIG. 5, the grate 112 contains holes 114 such that the cut smokeable material can pass through the grate 112 and into the lower chamber 106. The size of the holes 114 in the grate 112 can be from about 1 mm to about 10 mm in diameter with from about from about 4 to about 425 holes per square 25 mm. However, the holes 114 do not have to be circular; they can be any shape that allows the fill smokeable material to pass through the grate 112 from the upper chamber 104 to the lower chamber 106. The grate 112 can be removable so that it can be cleaned, or so that a grate 112 with different sized holes 114 can be used. The grate 112 may be attached to a shaft or may otherwise be driven by a motor 226 so that the grate 112 can be rotated to help smokeable material pass through the grate holes and into the lower chamber.

As shown in FIGS. 4, 9, 13-15, 19-21, and 22, the lower chamber 106 has an opening so that cut, or fill, smokeable material can pass into an opening in the wrapper 120 within the support 110. Preferably, the opening is narrower at the bottom of the opening than at the top of the opening and is shaped like a funnel or cone.

As shown in FIGS. 22-27, a fan or blower 504 may be situated in the upper chamber 104 apparatus 500, 600, 700. The fan or blower 504 may be attached to the drive 226 or a shaft 502 that it rotates when the motor 246 is turned on. The rotation of the fan or blower 504 creates airflow within the upper chamber 104 to help move smokeable material past the rotatable size reducers 230, through the holes of the grate 112, and into the lower chamber 106.

As shown in FIGS. 22-27, a sieve 704 may be attached to the drive 226 or a shaft 502 that it rotates when the motor 246 is turned on. The rotation of the sieve 704 facilitates the movement of smokeable material through the holes of the sieve 704, and into the lower chamber. The fan or blower 504, rotatable size reducer 230, and sieve 704 may all be attached to a shaft 502 so that they rotate simultaneously when the motor 246 is activated.

Figure 4:
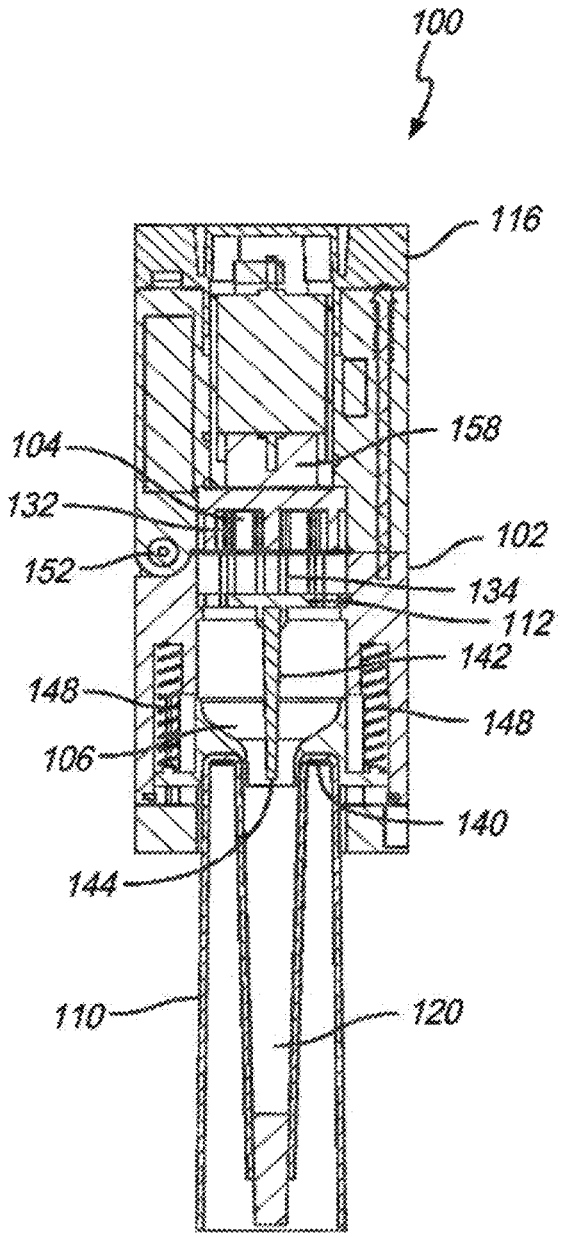
FIG. 4 is a longitudinal sectional view of the apparatus of FIG. 1 taken on line 4-4 in FIG. 1.
Figure 12:
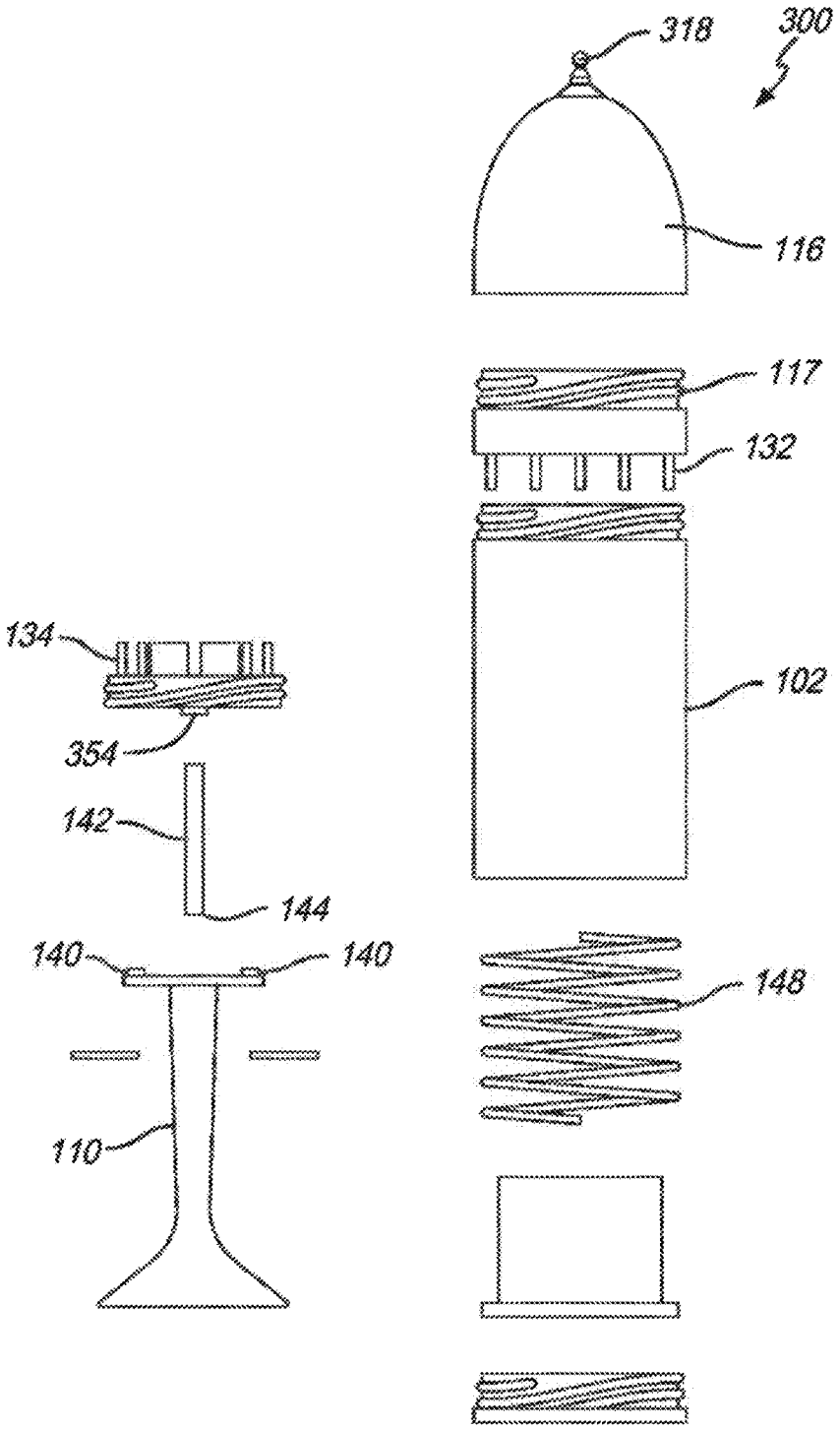
FIG. 12 is an exploded front elevation view of the apparatus of FIG. 10.
Figure 18:
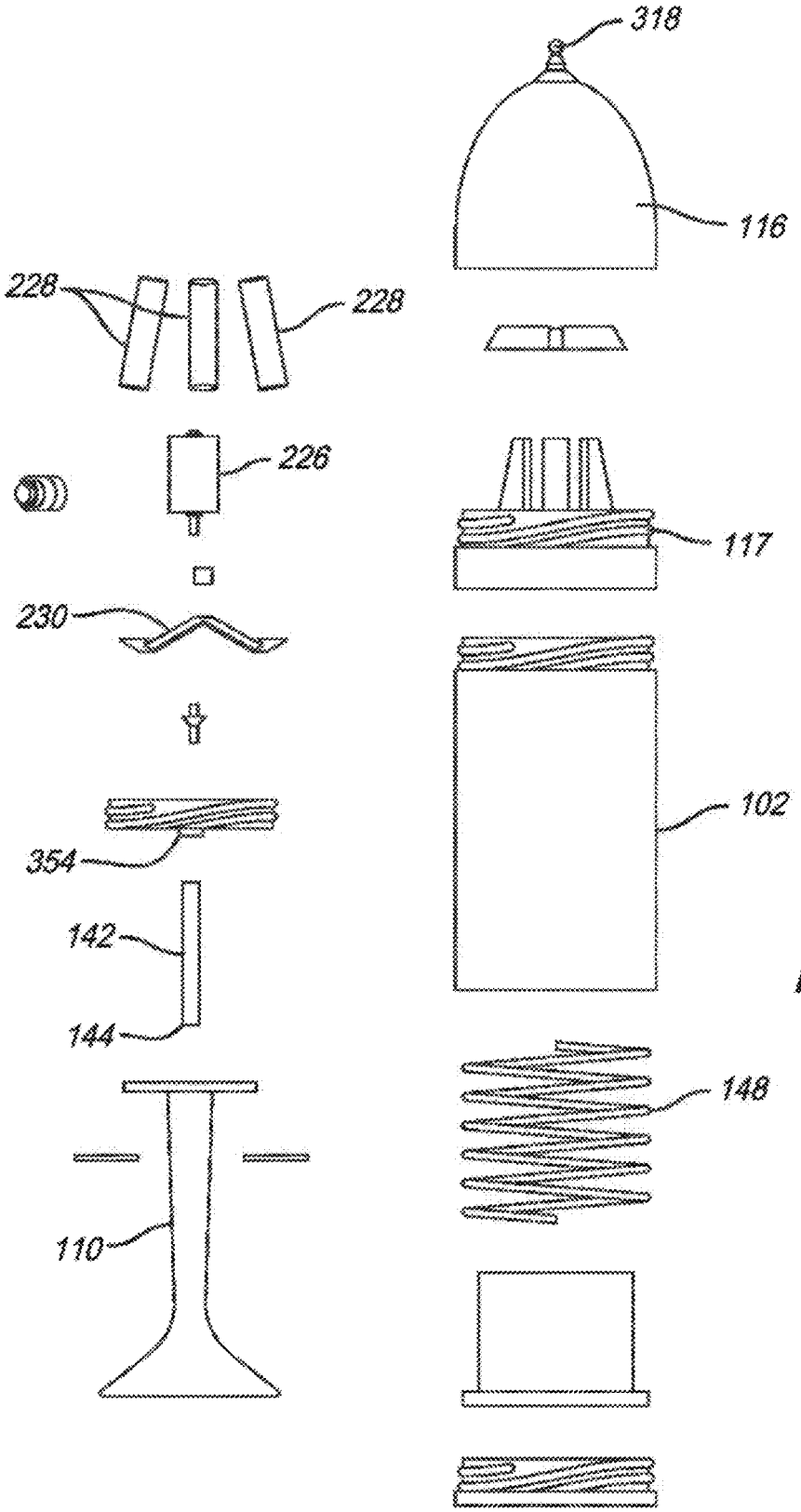
FIG. 18 is an exploded form elevation view of the apparatus of FIG. 16.

As shown in FIGS. 1-22, the apparatus 100, 200, 300, 400, 500, 600 can have a lid 116 above the upper chamber 104. As shown in FIGS. 12 and 18, it is contemplated that the lid 116 can be removable from the upper chamber 104 by, for example, threads 117 that unscrew and separate the lid 116 from the upper chamber 104. As shown in FIGS. 4, 9, and 22, the lid 116 can also be joined to the upper chamber 104 by, for example, a hinge 152, and as such the lid 116 flips off the upper chamber 104 but remains connected to the upper chamber 104 by the hinge 152.

In one embodiment, the lid 116 can have a pushing projection 318 sized for pushing the wrapper 120 containing smokeable material partly out of the support 110, shown in FIGS. 10-21, and 23. Although it is preferred that the projection 318 is on the lid 116, it can be on other places on the wall 102. Also, more than one pushing projection 318 can be provided.

Figure 8:
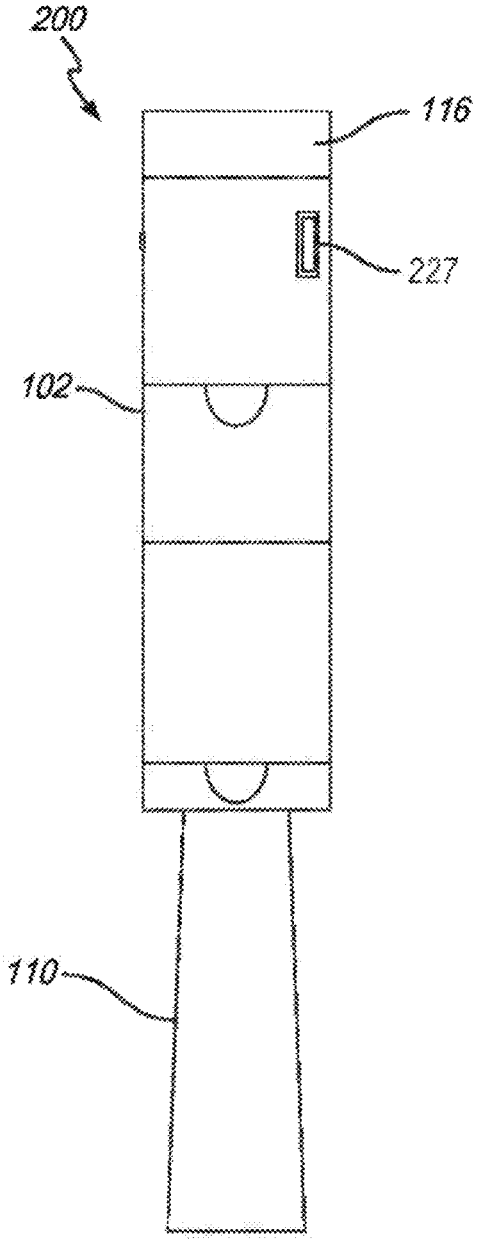
FIG. 8 is a side elevation view of the apparatus of FIG. 6 taken on line 8-8 in FIG. 6.
Figure 9:
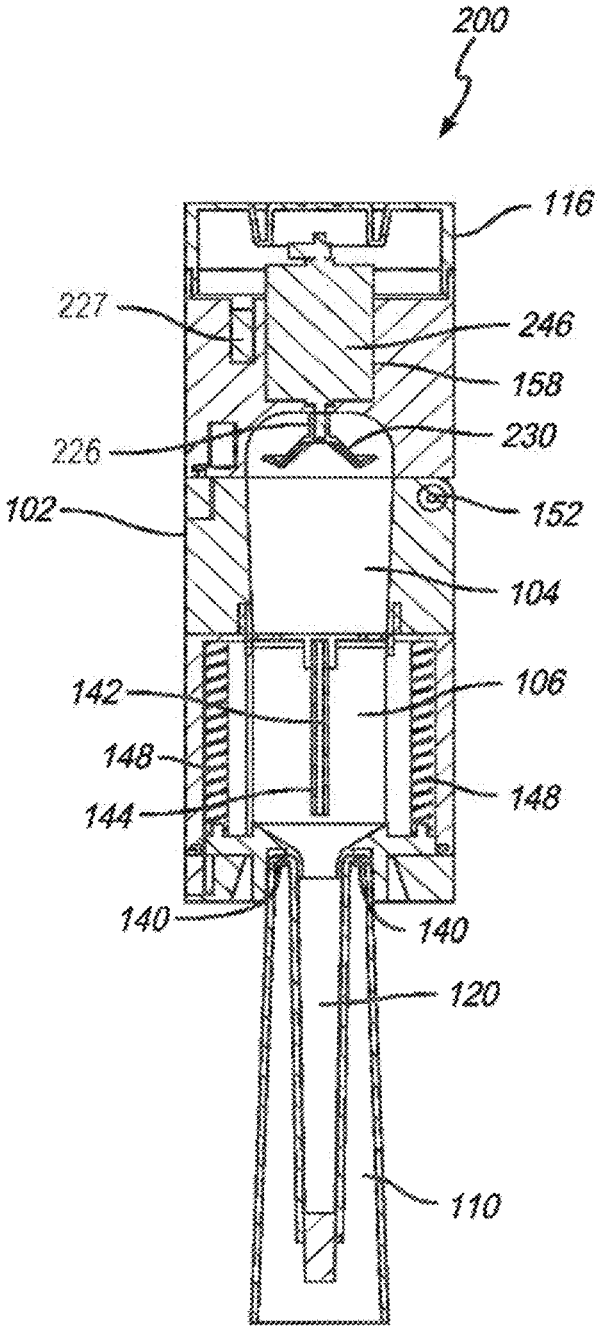
FIG. 9 is a longitudinal sectional view of the apparatus of FIG. 6 taken on line 9-9 in FIG. 6.
Figure 10:
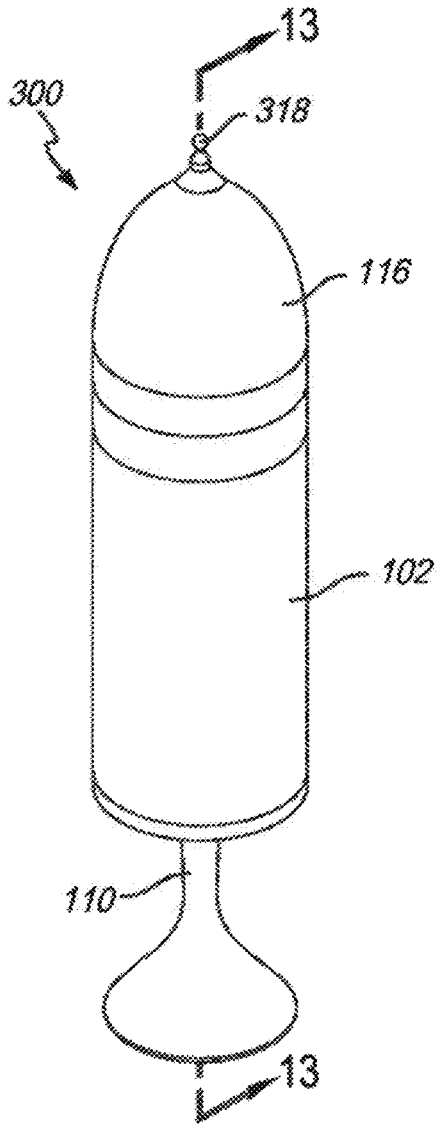
FIG. 10 is a perspective view of a third apparatus having features of the present design.
Figure 11:
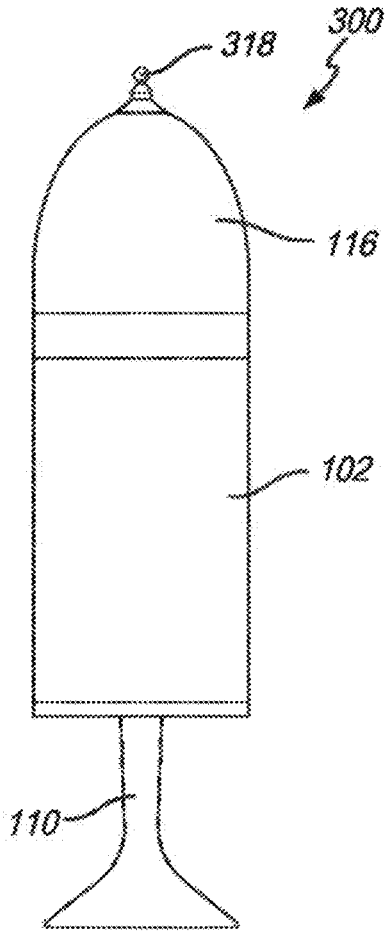
FIG. 11 is a front elevation view of the apparatus of FIG. 10.

In another embodiment, as shown in FIG. 8, the apparatus can contain means for electrically charging the apparatus such as, for example, a USB port 227 or port for a battery charger such as a DC port.

The apparatus 300, 400 can also have a storage area 324 for storing the smokeable material, as shown in FIGS. 13-15 and 19-21. Preferably, the storage area 324 is located above the upper chamber 104. The storage area 324 can be accessed by separating the storage area 324 from the upper chamber 104, or it can be accessed by the fill inlet 156.

In one embodiment, as shown in FIGS. 4, 9, and 22, there is a cavity 158 above the upper chamber 104 and separated by a wall 102. The cavity 158 can contain a motor 246 if the device is powered, as shown in FIG. 9. Alternatively, the motor can be located in the lower chamber 106. The cavity 158 can also contain the energy source 228 for powering the motor 246, such as, for example, a battery holder and batteries.

Figure 23:
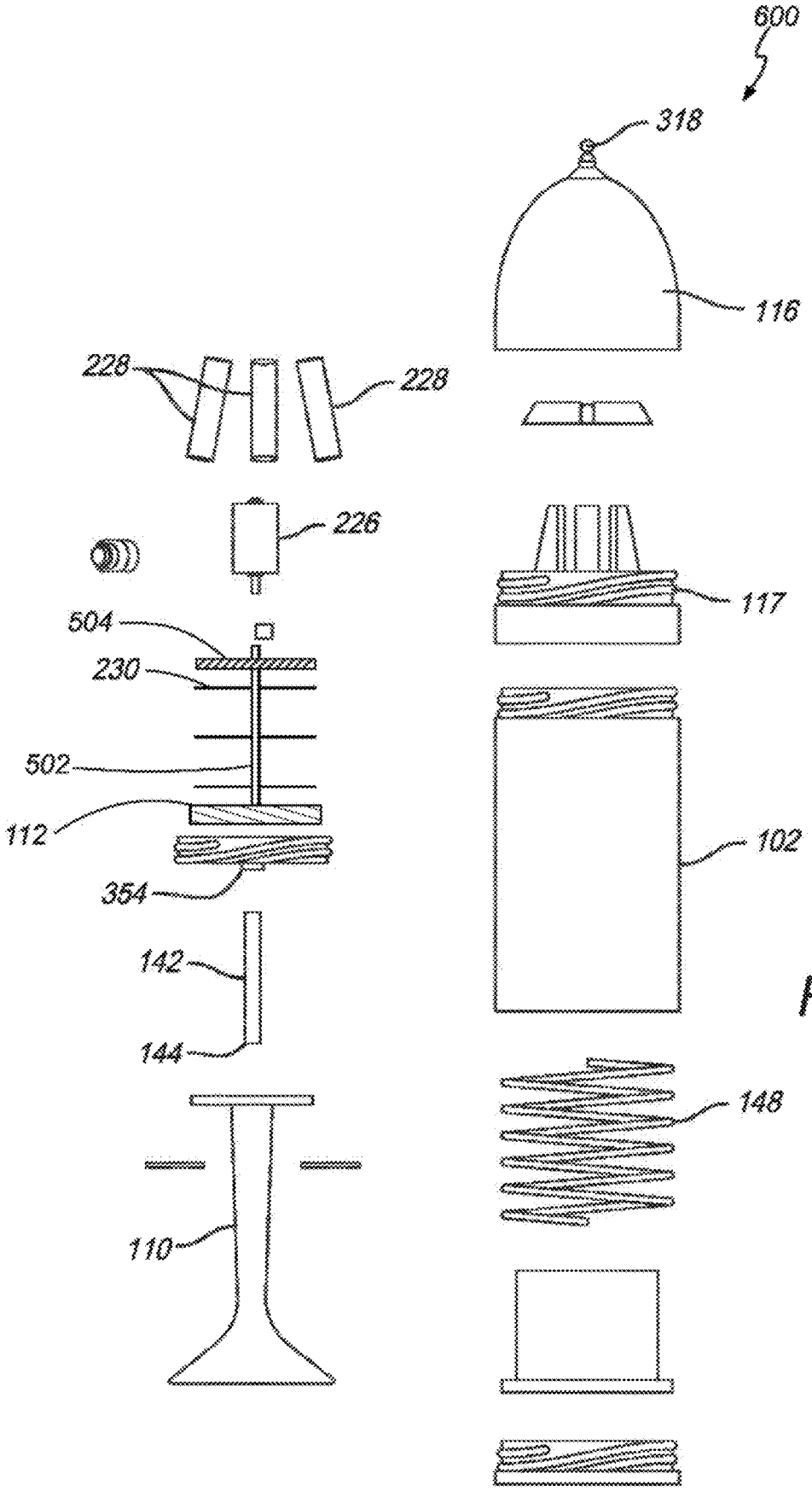
FIG. 23 is an exploded form elevation view of one embodiment of the apparatus.

The upper chamber 104 can be accessed by unfastening a portion of the wall 102, such as, for example, unfastening the lid 116, as shown in FIGS. 12, 18, and 23.

As shown in FIGS. 4, 9, 12-15 and 18-27, the apparatus 100, 200, 300, 400, 500, 600, 700 also contains a size reducer in the upper chamber 104 for reducing the size of the feed smokeable material into fill smokeable material such that the fill smokeable material can pass through the holes 114 in the grate 112 or through a sieve 704 and out of the upper chamber 104, such as into the lower chamber 106. However, some or all of the feed smokeable material may already be sized to pass through the grate 112. Thus, although there is a size reducer in the apparatus 100, 200, 300, 400, 500, 600, 700 it does not always need to be used.

Any mechanism for reducing the size of feed smokeable material can be used; however, it is contemplated that the mechanism can be a blade, a grinder, a chopper, a mincer, wires, or a combination thereof. The size reducer can be activated manually or automatically.

An exemplary size reducer that can be used manually or powered with the motor 246 is a grinder having a first plate with grinding projections 132 opposed to a second plate with grinding projections 134 for grinding feed smokeable material therebetween, as shown in FIGS. 4, 9, and 12-15. In one aspect, the second plate with grinding projections 134 can be attached to the grate 112.

With a manual rotatable size reducer, as shown in FIGS. 4 and 12-15, the upper portion of the wall containing the upper chamber 104 can be rotatable relative to the lower portion of the wall containing the lower chamber 106 and is graspable by a user's hand. In use, a user grasps the upper portion of the wall containing the upper chamber 104 in one hand, the lower portion of the wall containing the lower chamber 106 in the other hand, and twists the two portions relative to each other.

Another exemplary automatic size reducing mechanism, shown in FIGS. 9 and 18-21 is a rotatable size reducer 230, such as a rotatable blade or a plurality of blades, which is rotatable from 1 to 360 degrees in a clockwise direction, counterclockwise direction, or both directions. It is not a requirement that the blade can fully rotate 360 degrees.

Another exemplary automatic size reducing mechanism, shown in FIGS. 22-27 is a rotatable size reducer 230, such as a wire or plurality of wires, which is rotatable from 1 to 360 degrees in a clockwise direction, counterclockwise direction, or both directions. It is not a requirement that the wire can fully rotate 360 degrees.

As shown in FIGS. 9, 19-27, in an apparatus 200, 400, 500, 600, 700 containing an automatic size reducing mechanism, there is a drive 226 that is connected to the motor 246 with a power source 238 for rotating the automatic rotatable size reducer. A typical motor 246 has a horsepower of from about 0.001 to 4. The power source 238 can be powered by an electric current provided by an alternating current (AC) or a direct current (DC). Sources of direct current are, for example, batteries, thermocouples, and solar cells. The motor 246 can be controlled by a switch 250 or button 702 used to turn the power source 238 off and on, or incrementally varying the speed of the motor 246. It is contemplated that the motor 246 can be run at variable speeds.

In addition, the motor 246 can be used to vibrate, or shake, the entire apparatus 200, 400, 500, 600, 700 such that the fill smokeable material passes from the upper chamber 104, through the grate 112 or sieve 704, out of the uppermost chamber, such as into the lower chamber 106 or into the wrapper 120. It is contemplated that one or more than one motor 246 can be used to vibrate the apparatus in an apparatus containing either manual or automatic size reducers to aid in packing the fill smokeable material into the wrapper 120. A suitable motor that can cause vibration and drive the size reducer is any micro DC motor or brushless motor, as described above, as long as the motor is powerful enough to shake the wall 102 or entire device. Alternatively, a counterweight can be mounted to the motor shaft which causes vibration though the entire apparatus. In one embodiment, the vibration of the apparatus 200, 400 causes the free end 144 of the tamper 142 to whip back and forth. The whipping action also helps to pack the smokeable material into the wrapper 120.

The apparatus 100, 200, 300, 400, 500, 600, 700 also contains a support 110 as shown in FIGS. 1-27. The support 110 is used to support the wrapper 120 below the lowermost chamber. The support 110 has a generally cylindrical elongated opening for receiving the wrapper 120 and a tubular portion that holds the wrapper. The support 110 can extend through the opening of the lowermost chamber, such as the lower chamber 106. In one aspect, the support 110 is removably attached to the lower chamber 106 by, for example, magnets 140.

The wrapper 120 can be made from paper or other combustible material. The wrapper 120 is sized to fit into the support 110. For example, the size of the wrapper 120 can be between about 15 cm and about 50 cm long, and can be up to 5 cm wide in diameter at the top and 10 mm wide in diameter at the bottom if conical. The shape of the wrapper 120 can be any shape to fit the support, for example it can be conical or straight. A conically shaped wrapper 120 can have a larger diameter at the fill end and a small diameter at the opposite end. The wrapper 120 has a sealed end that, in use, is placed at the lower end of the support 110, and an open end at the top of the support 110. The apparatus 100, 200, 300, 400, 500, 600, 700 can be provided with multiple supports 110, such as a conical support for conical wrappers and a support with substantially constant internal diameter for straight wrappers.

Figure 15:
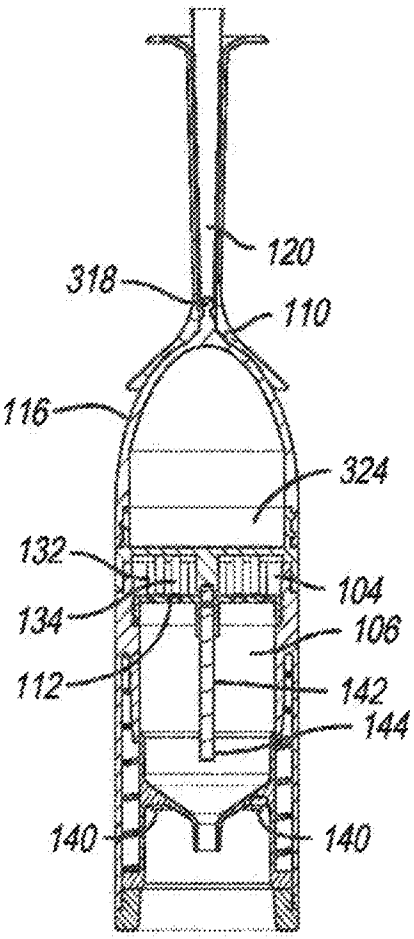
Figure 16:
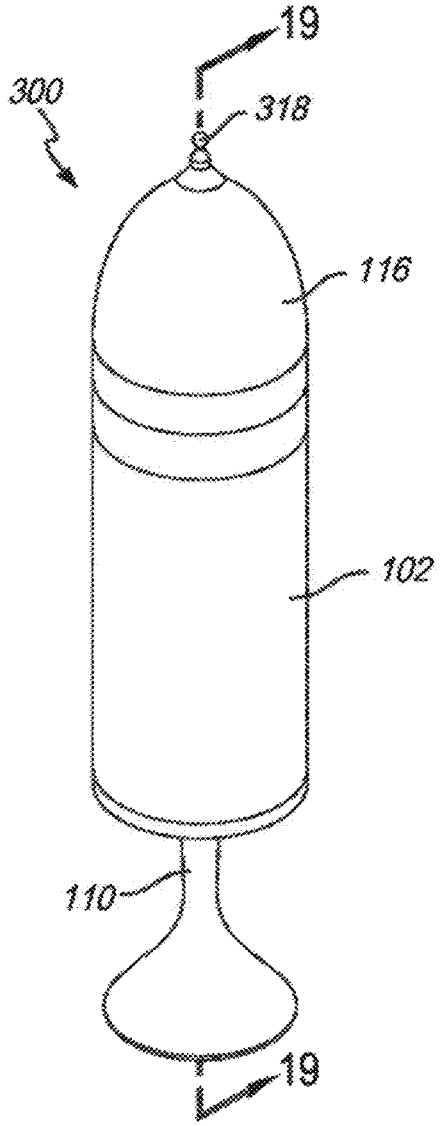
FIG. 16 is a perspective view of a fourth apparatus having features of the present design.
Figure 17:
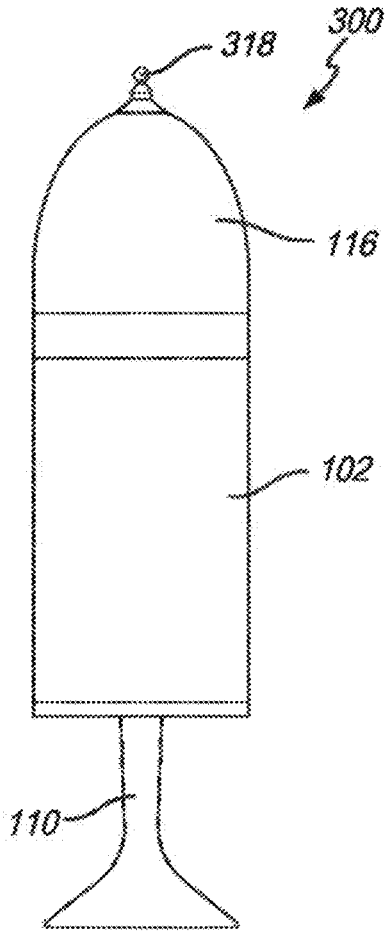
FIG. 17 is a front elevation view of the apparatus of FIG. 16.
Figure 21:
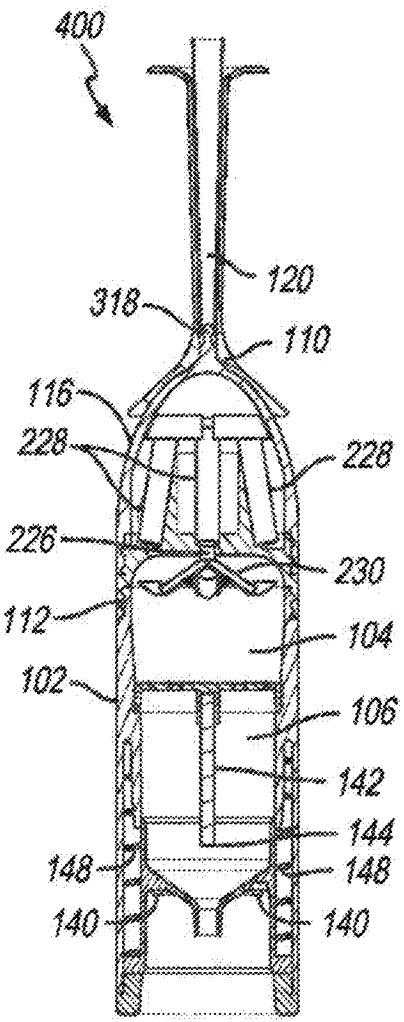
FIGS. 19-21 are partial longitudinal sectional views of the device of FIG. 16 taken on line 19-19 in FIG. 16 showing the positions of the device during its use.
Figure 22:
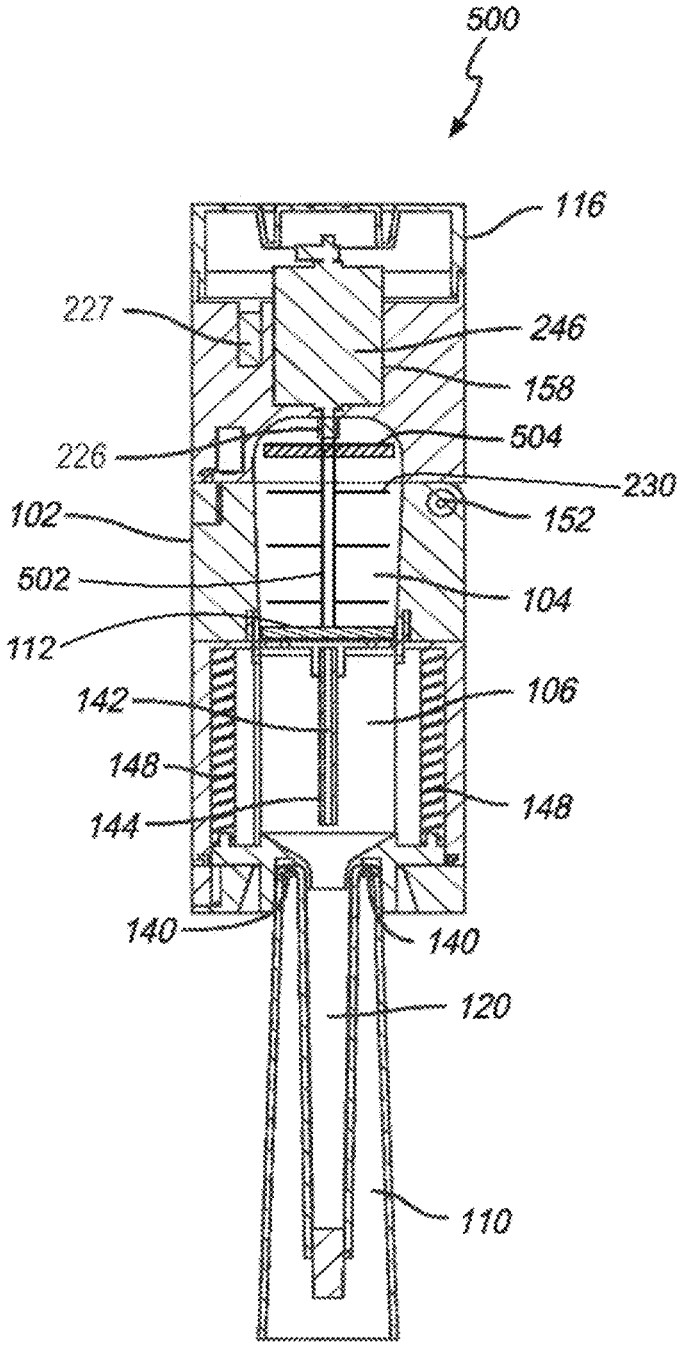
FIG. 22 is a longitudinal sectional view of one embodiment of the apparatus.

The support 110 can be removed from the lowermost chamber of the wall 102 and attached to the lid 116 such that the projection 318 on the lid 116 can push the wrapper 120 containing smokeable material partly out of the support 110, as shown in FIGS. 15 and 21.

As shown in FIGS. 4, 9, 12-15, and 18-23, the apparatus 100, 200, 300, 400, 500, 600 can contain a tamper 142 for tamping smokeable material into the wrapper 120. The tamper 142 is located in the lower chamber 106 and can be secured or removably secured to the grate 112. The tamper 142 is axially movable, having an upper position and a lower position such that the fill smokeable material is tamped into the wrapper 120. The free end 144 of the tamper 142 is sized so that it can fit into the open end of the wrapper 120. Preferably, the tamper 142 also provides a piston-like effect so that pushing downwardly compresses air in the lower chamber, thereby forcing fill smokeable material into the open end of the wrapper 120 and compressing it therein for a consistent, uniform smoke. In one embodiment, it is contemplated that the tamper 142 can be removably secured to the grate 112 by means of a magnet 354 as shown in FIGS. 12 18, and 23.

The tamper 142 can be rigid or flexible depending on the hardness of the material used. Preferably, the tamper 142 can be made from a soft material, such as, for example, a polymer such as rubber, or a spring such as a metal spring. The hardness of the tamper 142 is in the range of from about 15-30 on a durometer shore 00 hardness scale and up to 80 on a durometer shore D hardness scale. It is contemplated that the tamper 142 can be removable and replaceable, and thus sold separately from the remainder of the apparatus 100, 200, 300, 400, 500, 600 so that tampers of different hardness, and thus different flexibilities, can be used or worn out tampers 142 can be replaced. In one aspect, only the bottom portion of the tamper 142 need be flexible.

The apparatus 100, 200, 300, 400, 500 is biased so that the wall 102 and the tamper 142 is in an upper position, as shown in FIGS. 4, 9, 13, 19, and 22. The biasing can be done via any biasing means, such as, for example, a piston or one or more springs 148 located, for example, within the wall of the apparatus 100, 200, 300, 400, 500 as shown in FIGS. 4, 9, 13-15, and 19-22. In one embodiment, the spring 148 can be sized to span the circumference of the wall 102. Alternatively, there can be two springs 148 placed on opposite sides of the wall 102.

Figure 13:
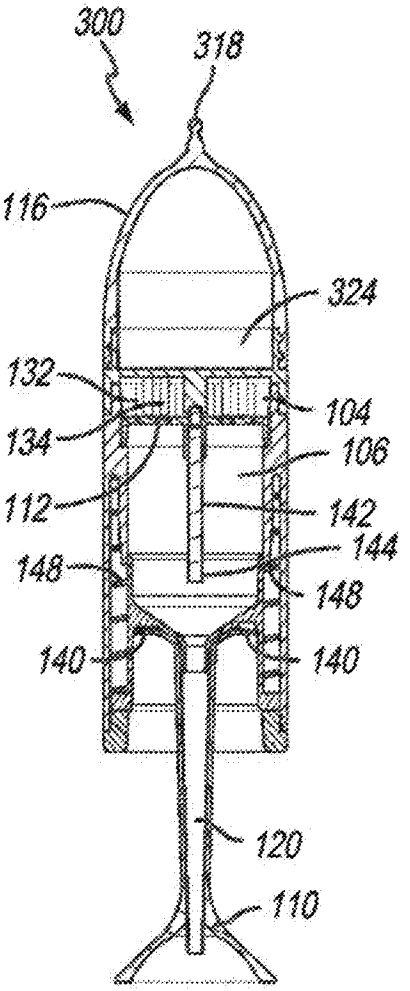
FIGS. 13-15 are partial longitudinal sectional views of the device of FIG. 10 taken on line 13-13 in FIG. 10 showing the positions of the device during use.
Figure 14:
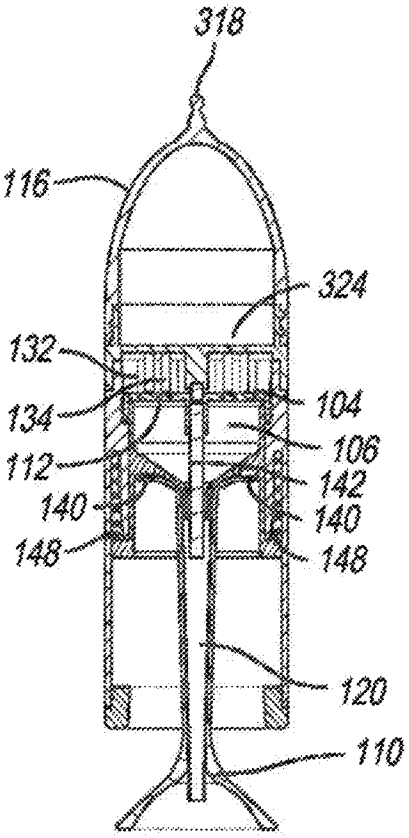
Figure 20:
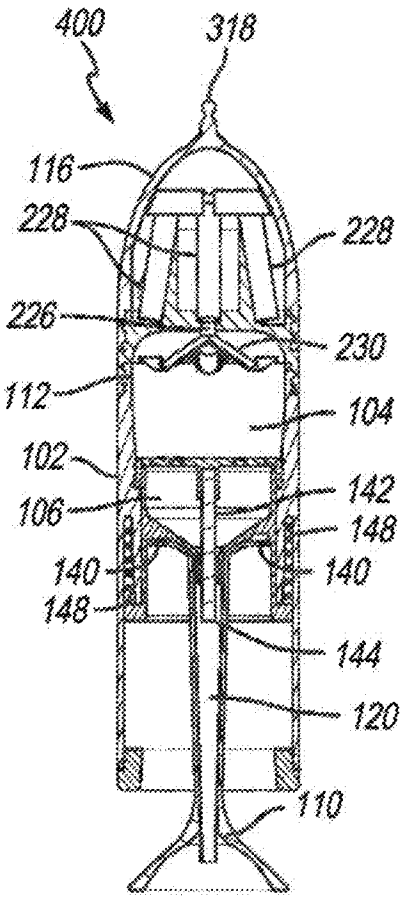
Figure 19:
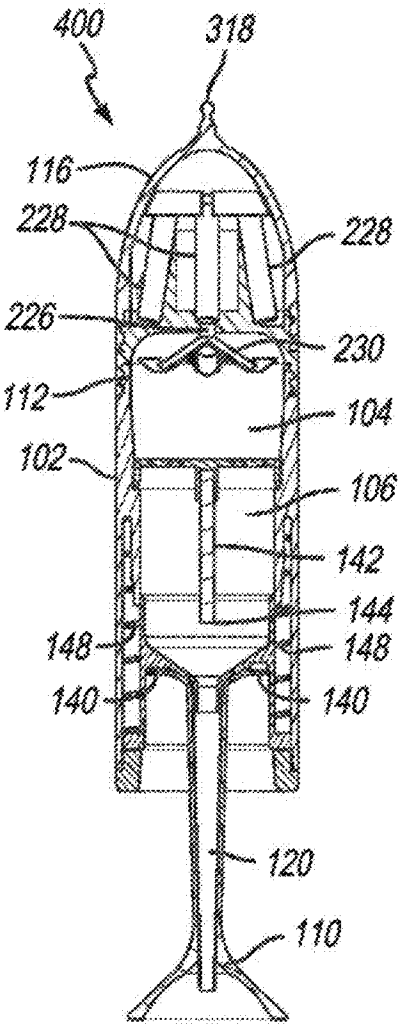

In use, the wall 102 is movable downwardly from an upper position to a lower position relative to the support 110 for moving the grate 112 downwardly, thus causing the tamper 142 to move downwardly for tamping smokeable material in the wrapper 120. FIGS. 13 and 19 show an embodiment of the apparatus 300, 400 and tamper 142 in a first upper position. The user can push the top of the apparatus 300, 400 in a downward direction, axially moving the tamper 142 so that the tamper 142 moves to a second lower position into the wrapper 120 as shown in FIGS. 14 and 20. The user then releases the top of the apparatus 300, 400 such that the tamper 142 returns to the first position. The user can remove the support 110 from the lower chamber 106, and use the projection 318 on the lid 116 to push the wrapper 120 out of the support 110, as shown in FIGS. 15 and 21.

The apparatus 100, 200, 300, 400, 500, 600, 700 of the design preferably contains one or more of the elements described above integrated into a single device.

The design also provides a kit containing an apparatus 100, 200, 300, 400, 500, 600, 700 for preparing a smokeable product, as described above. The kit contains a removable first tamper 142. The kit also contains one or more removable second tampers 142. The removable second tamper 142 can have a hardness that is identical to the first tamper 142. Alternatively, the second tamper 142 can be more hard or less hard than the first tamper 142.

An alternate kit of the design can contain an apparatus 100, 200, 300, 400, 500, 600, 700 as described above with a removable first grate 112. The kit also contains a removable second grate 112 with holes that differ in size from the first grate 112. It is also contemplated that a kit of the design contains both removable and replaceable tampers 142 and removable and replaceable grates 112.

In use, a user places feed smokeable material through the fill inlet into the upper chamber 104. The user also places a wrapper 120 in the support 110 and places the support on the apparatus 100, 200, 300, 400, 500, 600, 700. The user then activates the size reducer so at least a portion of the feed smokeable material falls through the grate 112 as fill smokeable material into the lower chamber 106.

For operation of the size reducer in an apparatus 100, 300 with a manual size reducer such as a grinder, the user can, for example, twist the portion of the apparatus 100, 300 containing the wall 102 with the upper chamber 104 containing the first grinding plate 132 in a clockwise direction, while simultaneously twisting the lower chamber 106 the second grinding plate 134 in the opposite, counterclockwise direction. Once most or all of the feed smokeable material is sized to fall through the grate 112 or sieve 704, the user can stop twisting the upper 104 and lower chambers 106. Alternatively, for operation of the size reducer in an apparatus 200, 400, 500, 600, 700 with an automatic size reducer 230, such as a rotatable blade or wire, the user can, for example, switch on the motor 246 via a switch 250 or button 702 on the outside of the apparatus 200, 400, 500, 600, 700. The motor 246 is attached to a drive 226, which drives power to the rotatable blade 230 so that it can rotate. Once most or all of the feed smokeable material is sized to fall through the grate 112 or sieve 704, the user can switch off the motor 246.

The fill smokeable material thereafter falls through the opening into the wrapper 120. If desired, the user can force the tamper 142 downwardly against the force of the biasing means for tamping fill smokeable material in the wrapper 120. If needed, the user can inspect the wrapper 120 for the desired amount of fill smokeable material in the wrapper 120, and thereafter repeats the steps one or more times until the desired amount of fill smokeable material is contained in the wrapper 120.

Thereafter, the user can remove the support 110 from the lower chamber 106 and remove the filled wrapper 120 from the support 110. In one aspect, the user can remove the support 110 from the lower chamber 106 and use the projection 318 on the lid 116 to push the wrapper 120 containing fill smokeable material from the support 110. The user then closes the opening of the wrapper 120, thus forming a smokeable product.

It is contemplated that the time for the smokeable product to be produced from the starting feed smokeable material is ten seconds or less.

EXAMPLES

Example 1—Apparatus

An apparatus to prepare a smokeable product was assembled. The size of the apparatus is approximately 150 mm at the maximum diameter. The apparatus had a wall which provided an upper chamber and a lower chamber. There was a grate located between the chambers. The hole size of the grate was 5 mm with 30 holes per square 25 cm. The apparatus also had a removable lid above the upper chamber for placing feed smokeable material into the upper chamber. The lid contained a projection that can be used for pushing a filled wrapper out of the support.

Also in the lid area was a motor, a power source for powering the motor, and a drive between the motor and a rotatable blade to rotate the blade. The rotatable blade was located on the upper surface of the wall of the upper chamber. The speed of the motor was varied by means of a switch located on the outside of the wall.

The apparatus also had a support below the lower chamber for supporting a paper wrapper. The support was removably attached to the lower chamber by magnets. The support was 130 mm long and 24 mm wide. The wrapper was conically shaped and was 100 mm long, 10 mm in diameter at the top and 5 mm in diameter at the bottom. The wrapper was sealed at the bottom before it was placed into the support. The lower chamber had an opening for fill smokeable material to pass into the wrapper. The apparatus also had an axially movable tamper made out of rubber located in the lower chamber. The tamper had an upper position and a lower position. There was a spring for biasing the tamper into its upper position, as well as a mechanism for moving the tamper from its upper position to its lower position against the spring biasing means.

Example 2—Method of Using the Apparatus

The apparatus described in Example 1 was used to fill a cigarette. To use, the user removed the lid above the upper chamber and placed feed smokeable material into the upper chamber. The user also placed a conical-shaped paper wrapper that was sealed on one side and open on the opposite side in the support and attached the support to the lower chamber. The user then activated the motor driving the rotatable blade with the switch. After activation, a portion of the feed smokeable material fell through the grate into the lower chamber.

Once the user believed enough of the feed smokeable material was cut to fall through the grate and fill the wrapper to a desired amount, the user turned off the motor. The cut smokeable material fell through the opening into the wrapper. To compress the fill smokeable material, the user forced the tamper downwardly against the force of the spring biasing means.

The user inspected the wrapper for the desired amount of fill smokeable material in the wrapper, and repeated some of the steps until the desired amount of fill smokeable material was contained in the wrapper. In some instances it was necessary to start up the motor to cut additional feed material.

The user then removed the support from the lower chamber and used the projection on the lid to push the wrapper containing fill smokeable material from the support. The user then closed the opening of the wrapper, forming a cigarette.

Figure 25:
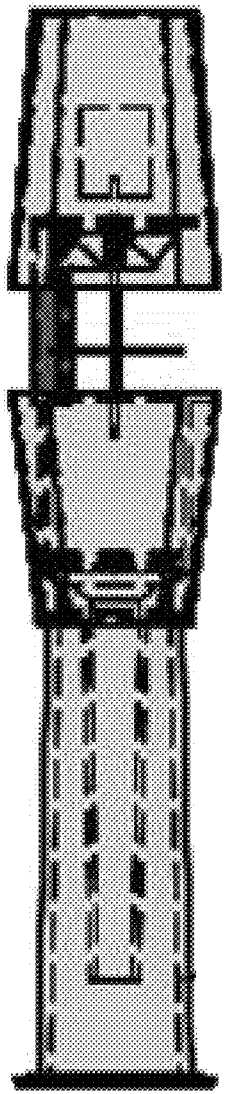
FIGS. 24 and 25 are partial longitudinal sectional views of an alternative embodiment of the apparatus.
Figure 24:
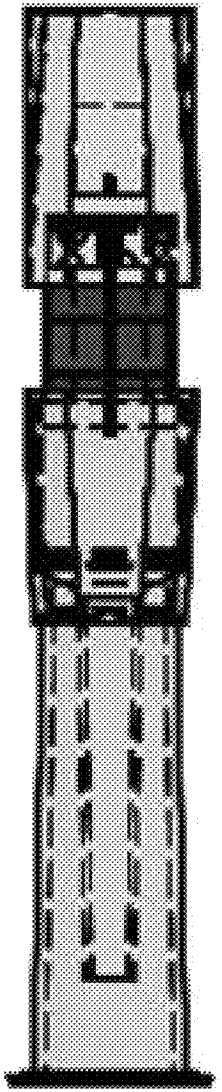
Figure 26:
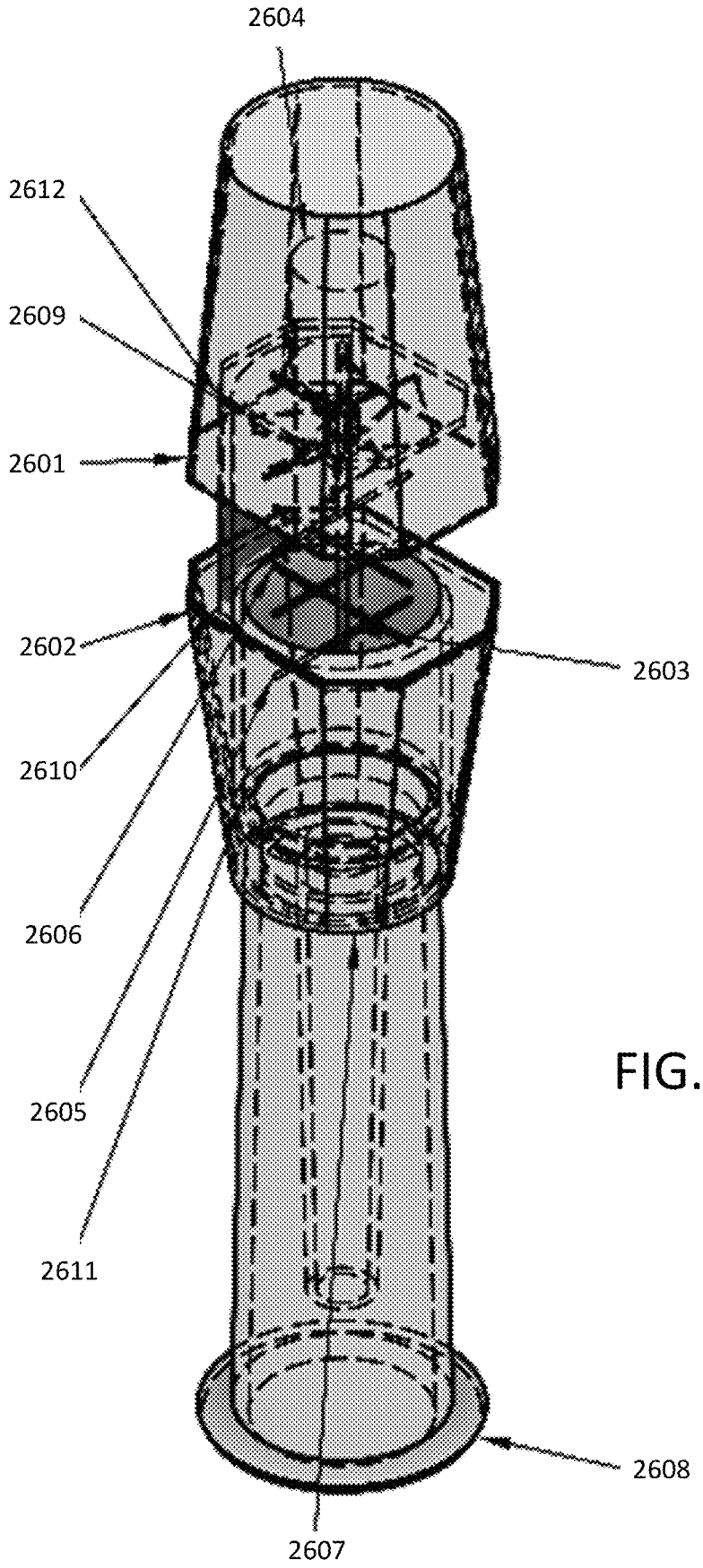
FIG. 26 is an exploded perspective view of the apparatus of FIGS. 24 and 25.

FIGS. 24 and 25 illustrate general representations of a further embodiment of the present design. FIG. 26 illustrates a perspective view of the embodiment presented in FIGS. 24 and 25. From FIG. 26, there is provided a top housing 2601 that fits atop a motor mount and inner tube 2602 and includes an inner rotating element shown as motor shaft 2603. Motor 2604 is shown that drives, via motors shaft 2603, whips 2605 and 2606. A lower housing 2607 is presented, as well as "O" tube 2608 useful in preparing filled wrappers wherein ground material falls, using gravity, or is pushed using fan 2609, into a wrapper provided on "O" tube 2608. A fan or fan blade 2609 is shown, used to drive, using received air, product into a wrapper provided in "O" tube 2608. Also shown is lift rail 2610, enabling lifting of top housing 2601 and other components contained within top housing 2601. Screen 2611 may be provided to filter material. Motor mount 2612 is also presented.

Figure 27:
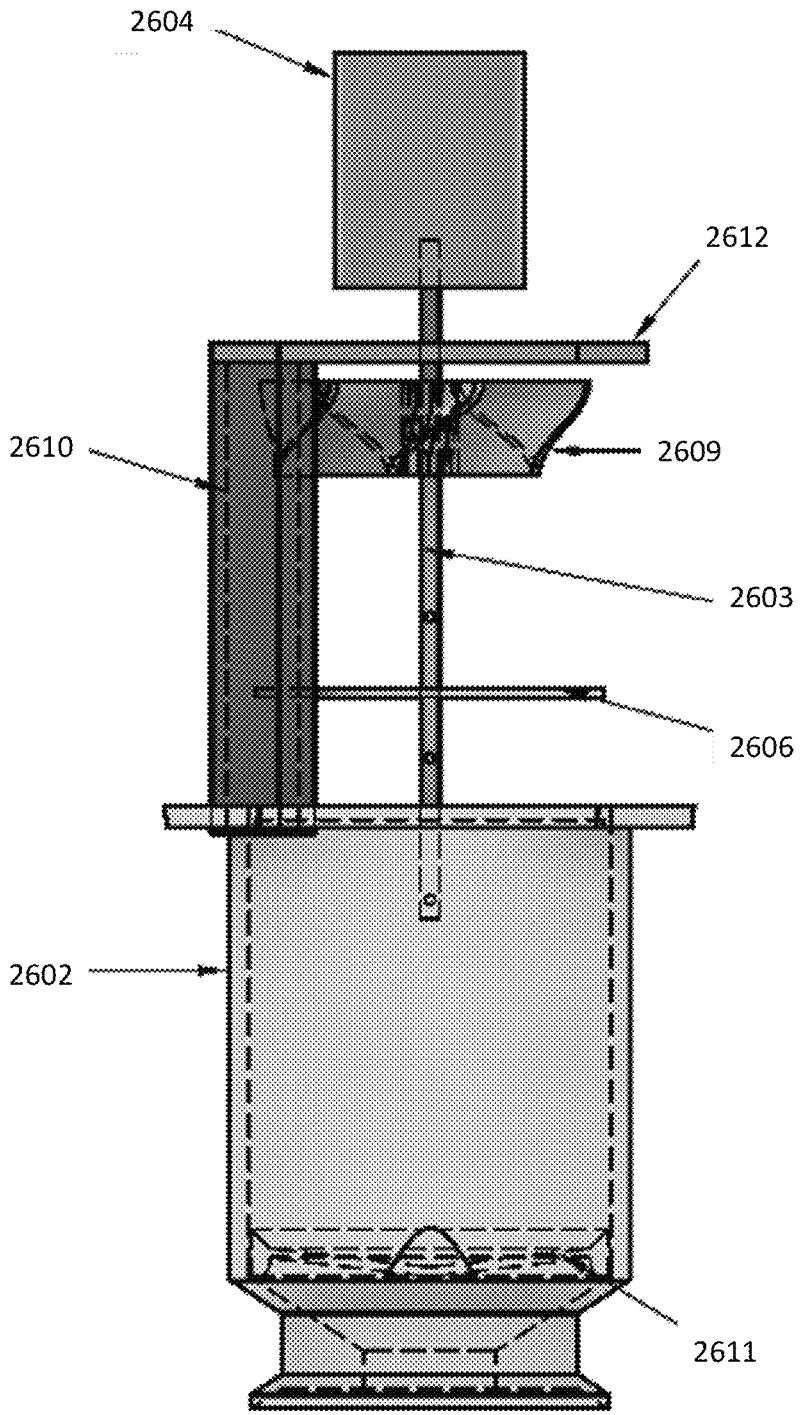
FIG. 27 is a view of certain components of the apparatus of FIGS. 24-26.

FIG. 27 shows a side view of the design in a lifted orientation, with motor mount and inner tube 2602 shown including screen 2611. Motor shaft 2603 is joined to whips 2606, with fan blade 2609 also presented. Lift rail 2610 is also included below motor mount 2612 and motor 2604 is shown. In operation, motor 2604 may be turned on via a switch (not shown in these views), thus rotating motor shaft 2603 and whips 2606 and may also rotate fan blade 2609. Using this design, product may be ground and provided to a rolling paper, for example, provided below with "O" tube 2608. In general, the components identified in FIGS. 26 and 27 may be fabricated from steel, but other components (plastics, composites, etc.) may be employed as practical.

Figure 28:
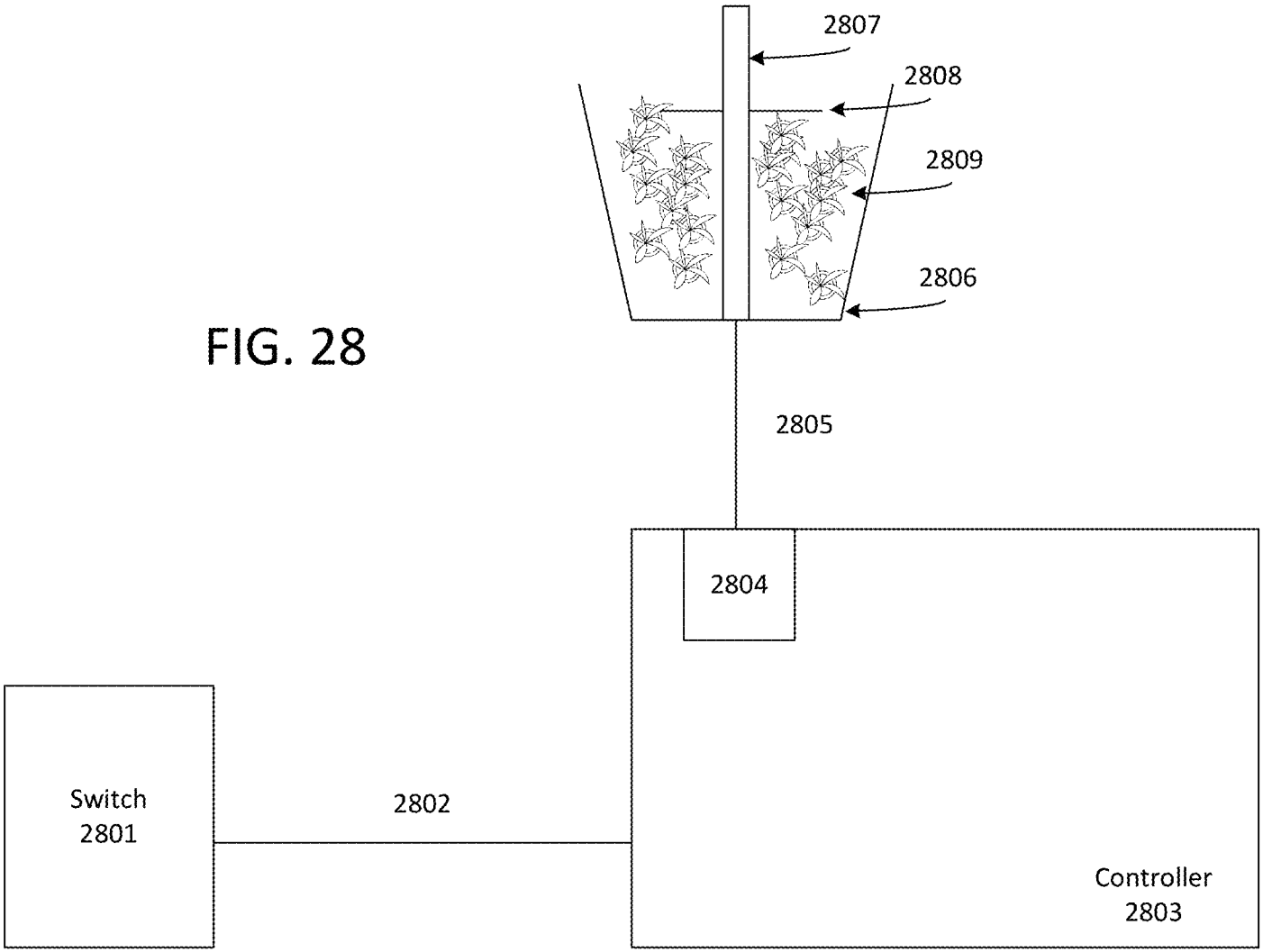
FIG. 28 is a general electrical representation of an advanced grinding operation employed in the present design.

Additional functionality of the device includes an attribute wherein the device includes a controller that serves to selectively change direction of rotation of the motor shaft to improve the grinding of product. FIG. 28 illustrates a general overview of the electrical components that may be employed to effectuate the functionality described herein. In one instance, the user may turn on the device as shown by on/off switch 2801. The device applies power to line 2802, initiating controller 2803. Controller 2803 in this embodiment includes an amperage monitoring element 2804. When initiated, the controller provides current along line 2805 to the apparatus, represented here as base 2806, rotating element 2807, grinding components 2808, and material 2809. Controller may operate for a period of time, such as anywhere from 1 to 10 seconds, or 5 to 7 or 8 seconds, and may cease. During operation, electrical power is applied such that rotating element 2807 rotates in a given direction, such as clockwise, and the grinding components grind the material 2809.

At a desired time, grinding may cease, or direction of grinding may reverse. By way of example and not limitation, grinding may occur via clockwise rotation for seven seconds at which time controller 2803 initiates a reversal of direction and causes counterclockwise rotation for seven seconds. At any point, if the user turns on/off switch 2801 off, the controller stops and rotation of rotating element 2807 ceases. Other time periods and operation may be provided, e.g. counterclockwise for X seconds, clockwise for Y seconds, counterclockwise for Z seconds, stop.

Amperage monitoring element 2804 may be employed to monitor the amperage applied to motor, and if amperage required increases, such an increase indicates product is blocking movement or rotation of the whips. The controller then indicates a reverse of direction upon sensing the increase in amperage required by the amperage monitor 2804, reverses the direction of rotation of rotating element 2807, and such reversal increases the chance of successfully grinding product. The cycle may repeat, and may be timed or untimed. An untimed example of operation may include clockwise rotation for 6.3 seconds, sensing of excessive amperage and causing counterclockwise rotation for 8.2 seconds, sensing excessive amperage and rotating clockwise for 4.8 seconds, and so forth, until the user turns off the power switch or on/off switch. Alternately, grinding may stop at a predetermined time, such as 15 or 20 seconds after commencing. An alternate construction of the present design entails At a desired time, grinding may cease or direction of grinding may reverse. By way of example and not limitation, grinding may occur via clockwise rotation for seven seconds at which time controller 2803 initiates a reversal of direction and causes counterclockwise rotation for seven seconds. At any point, if the user turns on/off switch 2801 off, the controller stops and rotation of rotating element 2807 ceases. Other time periods and operation may be provided, e.g. counterclockwise for X seconds, clockwise for Y seconds, counterclockwise for Z seconds, stop.

Amperage monitoring element 2804 may be employed to monitor the amperage applied to the rotating element, but other forms of control may be provided. In one instance, a pressure transducer may be employed to sense mechanical resistance when the rotating element encounters force while grinding product, and the pressure transducer may provide signals or force/pressure values to controller 2803. When such force or pressure indications exceed a threshold, controller 2803 may reverse direction in an effort to further grind product.

While described herein as a circuit being used to reverse direction, it is to be understood that direction reversal can be performed in other ways, including but not limited to mechanically, using switches, gears, one or more clutches, and/or other rotation direction reversing devices.

Thus according to this embodiment of the present design, in general, there is provided a controller that may be turned on or otherwise initiated, that grinds product using a rotating element comprising whips, by rotating the rotating element in a first direction. After a period of time or when resistance to grinding is sensed, by monitoring applied amperage, sensing force, or otherwise, the controller 2803 reverses direction in an attempt to grind more product. This process of grinding and reversing repeats until the user either turns off the on/off switch or a time period is exceeded. Thresholds for reversing direction may vary depending on circumstances, but in one situation, exceeding an amperage when the whips cannot progress further is the threshold above which controller 2803 reverses direction. In one instance, if operation is impeded in both directions, the controller may cease rotation altogether.

Thus according to the present design, there is provided an apparatus for preparing a smokeable product comprising an upper chamber configured to receive feed material, a feed material cutting mechanism comprising a size reducer configured to rotate in two directions, a motor configured to rotate the feed material cutting mechanism, a controller configured to selectively reverse direction of rotation of the feed material cutting mechanism, a power source configured to drive the motor, a switch for turning the power source off and on, and a fan in the uppermost chamber configured to move feed material within the uppermost chamber to a lowermost chamber.

According to another aspect of the present design, there is provided an apparatus for preparing a smokeable product comprising a chamber and a lower chamber configured to receive smokable material a size reducer positioned within the chamber and configured to reduce smokeable material size, and a controller configured to alter movement of the size reducer when resistance to size reducer movement is encountered while the size reducer interfaces with the smokeable material provided in the chamber.

According to a further aspect, there is provided an apparatus for providing smokable material comprising a chamber formed by a plurality of joinable container elements and configured to receive smokable material, a size reducer positioned within the chamber and configured to reduce smokeable material size, and a controller configured to alter movement of the size reducer when resistance has been encountered by the size reducer from the smokeable material provided in the chamber.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for preparing a smokable product comprising:

a chamber configured to receive smokable material;

a size reducer positioned within the chamber and configured to reduce smokable material size;

a controller configured to reverse direction of rotation of the size reducer when resistance to size reducer movement is encountered while the size reducer interfaces with the smokable material provided in the chamber; and a fan positioned above the size reducer and configured to rotate and direct airflow and smokable material in a downward direction through the size reducer;

wherein the controller is configured to reverse direction of rotation of the size reducer a plurality of times such that alternately reducing smokable material size and reversing rotational direction repeats until manually or temporally halted.

2. The apparatus of claim 1, further comprising:

a motor configured to rotate the size reducer;

a power source configured to drive the motor; and a switch configured to turn the power source on and off.

3. The apparatus of claim 2, wherein the size reducer comprises a plurality of wires that rotate around a rotatable central axial member in the chamber.

4. The apparatus of claim 1, wherein the size reducer comprises a single wire attached to a rotatable central axial member.

5. The apparatus of claim 1, further comprising a a lower chamber configured to receive material ground by the size reducer in the chamber.

6. The apparatus of claim 1, wherein the controller:

controls rotation of the size reducer based on a resistance value comprising one of a sensed amperage and a sensed mechanical resistance encountered by the size reducer; and reverses direction of rotation based on the resistance value exceeding a predetermined threshold.

7. The apparatus of claim 1, further comprising a receiving element positionable below the chamber and configured to receive a wrapper, wherein the wrapper is configured to receive smokable material from the chamber that has been processed using the size reducer.

8. An apparatus for providing smokable material comprising:

a chamber formed by a plurality of joinable container elements and configured to receive smokable material;

a size reducer positioned within the chamber and configured to reduce smokable material size;

a controller configured to reverse direction of rotation of the size reducer when resistance has been encountered by the size reducer from the smokable material provided in the chamber; and a fan positioned above the size reducer and configured to rotate and direct airflow and smokable material in a downward direction through the size reducer;

wherein the controller is configured to reverse direction of rotation of the size reducer a plurality of times such that reducing smokable material size and reversing rotational direction repeats until manually or temporally halted.

9. The apparatus of claim 8, wherein the size reducer comprises a single wire attached to a rotatable central axial member.

10. The apparatus of claim 9, wherein the size reducer comprises a plurality of wires that rotate around the rotatable central axial member in the chamber.

11. The apparatus of claim 8, wherein the controller:

controls rotation of the size reducer based on a resistance value comprising one of a sensed amperage and a sensed mechanical resistance encountered by the size reducer; and reverses direction of rotation based on the resistance value exceeding a predetermined threshold.

12. The apparatus of claim 8, further comprising a receiving element positionable below the chamber and configured to receive a wrapper, wherein the wrapper is configured to receive smokable material from the chamber that has been processed using the size reducer.

13. An apparatus for preparing a smokable product comprising:

a chamber configured to receive smokable material;

a bidirectional rotating size reducer positioned within the chamber and configured to reduce smokable material size;

a controller configured to reverse direction of rotation of the size reducer when resistance to bidirectional rotating size reducer movement is encountered while the bidirectional rotating size reducer interfaces with the smokable material provided in the chamber; and a fan positioned above the size reducer and configured to rotate and direct airflow and smokable material in a downward direction through the size reducer;

wherein the controller is configured to reverse direction of rotation of the size reducer a plurality of times such that alternately reducing smokable material size and reversing rotational direction repeats until manually or temporally halted.

14. The apparatus of claim 13, further comprising a motor configured to rotate the bidirectional rotating size reducer.

15. The apparatus of claim 14, further comprising:

a power source configured to drive the motor; and a switch for turning the power source off and on.

16. The apparatus of claim 13 wherein a lowermost chamber receives smokable material and comprises a lower opening configured to pass feed material toward a collector.

17. The apparatus of claim 13, wherein the bidirectional rotating size reducer comprises a wire attached to a rotatable central axial member.

18. The apparatus of claim 17, wherein the bidirectional rotating size reducer comprises a plurality of wires configured to rotate in the chamber.

19. The apparatus of claim 13, further comprising:

a fill inlet; and a door having a closed position for substantially closing the fill inlet and an open position for opening the fill inlet.

20. The apparatus of claim 13, wherein the controller is configured to reverse direction of rotation based on a sensed mechanical resistance value exceeding a predetermined threshold.

* * * * *